US008955704B2

(12) United States Patent
Kwon

(10) Patent No.: US 8,955,704 B2
(45) Date of Patent: Feb. 17, 2015

(54) FOLDABLE UTILITY BOX

(76) Inventor: Soon Buem Kwon, Seoul (KR)

( * ) Notice: Subject to any disclaimer, the term of this patent is extended or adjusted under 35 U.S.C. 154(b) by 0 days.

(21) Appl. No.: 13/810,953

(22) PCT Filed: Apr. 19, 2011

(86) PCT No.: PCT/KR2011/002799

§ 371 (c)(1),
(2), (4) Date: Jan. 18, 2013

(87) PCT Pub. No.: WO2012/011655

PCT Pub. Date: Jan. 26, 2012

(65) Prior Publication Data

US 2013/0112686 A1 May 9, 2013

(30) Foreign Application Priority Data

Jul. 19, 2010 (KR) ..... 20-2010-0007552 U

(51) Int. Cl.
*B65D 90/02* (2006.01)
*B65D 6/22* (2006.01)
*B65D 6/16* (2006.01)

(52) U.S. Cl.
CPC *B65D 90/02* (2013.01); *B65D 7/28* (2013.01); *B65D 7/24* (2013.01)
USPC ..... 220/9.3; 220/9.2

(58) Field of Classification Search
CPC ..... B65D 90/02; B65D 7/28; B65D 7/24
USPC ..... 220/9.4, 9.3, 9.2; 363/119
See application file for complete search history.

(56) References Cited

U.S. PATENT DOCUMENTS

| | | | | |
|---|---|---|---|---|
| 4,938,243 | A * | 7/1990 | Foster | 135/136 |
| 6,250,488 | B1 * | 6/2001 | Narahara et al. | 220/1.6 |
| 6,409,076 | B1 * | 6/2002 | Wang | 229/122.34 |
| 6,508,376 | B1 * | 1/2003 | Chiang | 220/485 |
| 7,353,963 | B1 * | 4/2008 | Sabounjian | 220/9.4 |
| 7,635,064 | B2 * | 12/2009 | Wang | 220/9.2 |
| 8,047,391 | B2 * | 11/2011 | Lu | 220/9.4 |
| 2006/0163249 | A1 * | 7/2006 | Fu | 220/9.4 |
| 2008/0053995 | A1 * | 3/2008 | Wang | 220/9.2 |
| 2009/0078709 | A1 * | 3/2009 | Murrer, III | 220/592.2 |
| 2011/0215095 | A1 * | 9/2011 | Lin | 220/9.4 |
| 2012/0292211 | A1 * | 11/2012 | Elze et al. | 206/315.9 |
| 2013/0112686 | A1 * | 5/2013 | Kwon | 220/9.4 |
| 2013/0284734 | A1 * | 10/2013 | Huang | 220/9.4 |

FOREIGN PATENT DOCUMENTS

| | | |
|---|---|---|
| JP | 07-289362 | 11/1995 |
| KR | 20-0438375 Y1 | 2/2008 |
| KR | 2009-0002736 U | 3/2009 |

OTHER PUBLICATIONS

International Search Report for International Application No. PCT/KR2011/002799 mailed Jan. 4, 2012.

* cited by examiner

*Primary Examiner* — Steven A. Reynolds
*Assistant Examiner* — King M Chu
(74) *Attorney, Agent, or Firm* — Davis & Bujold, PLLC; Michael J. Bujold

(57) ABSTRACT

A foldable utility box which includes an upper loop formed in a rectangular shape; a pair of side supports each rotatably connected to two sides of the upper loop facing each other to thereby be in a first state in which they are in parallel with the upper loop or a second state in which they are vertical to the upper loop; and a shell member includes at least one door part so as to approach the pair of side supports and formed to enclose the upper loop and the pair of side supports to thereby be folded in the first state and have a hexahedral shape in the second state.

15 Claims, 8 Drawing Sheets

FOLDABLE UTILITY BOX

This application is a national stage completion of PCT/KR2011/002799 filed Apr. 19, 2011 which claims priority from Korean Application Serial No. 20-2010-0007552 filed Jul. 19, 2010.

TECHNICAL FIELD

The present invention relates to a utility box used to receive and arrange clothes, living articles, or the like.

BACKGROUND ART

Generally, a case type utility box for arranging and storing various articles is made of plastic, paper, wood, or the like, and is formed by connecting rectangular panels with one another using connecting units such as screws, rivets, an adhesive, and the like.

A height, a size, and a volume of the utility box are determined due to characteristics that each of the panels are rigid. Therefore, even at the time of not using the utility box, in order to store the utility box, a large space corresponding to the volume of the utility box is required.

In addition, even when transporting the utility box at the time of not using the utility box, inconvenience occurs because of a large volume of the utility box. As a size of the utility box is enlarged in order to store a large article, inconvenience in storage and transportation at the time of not using the utility box is increased.

DISCLOSURE

Technical Problem

An object of the present invention is to provide a foldable utility box capable of being changed between a box form and a folded form and maintaining its form when it is in the box form.

Another object of the present invention is to provide a foldable utility box capable of being changed between a box form and a folded form and maintaining its form when it is in the box form so as to be robust to a load applied from the outside.

Still another object of the present invention is to provide a foldable utility box capable of being changed between a box form and a folded form and increasing convenience of an operation for the change.

Technical Solution

According to an exemplary embodiment of the present invention, there is provided a foldable utility box including: an upper loop formed in a rectangular shape; a pair of side supports each rotatably connected to two sides of the upper loop facing each other to thereby be in a first state in which they are in parallel with the upper loop or a second state in which they are vertical to the upper loop; and a shell member including at least one door part so as to approach the pair of side supports and formed to enclose the upper loop and the pair of side supports to thereby be folded in the first state and have a hexahedral shape in the second state.

In the second state, a front surface of the shell member may be provided with one of the at least one door part and both sides thereof may face the pair of side supports, respectively, such that the shell member has a rectangular parallelepiped shape, and the foldable utility box may further include a rear support disposed to be rotatably connected to one side other than the two sides of the upper loop to face a rear surface that is in parallel with the front surface in the second state.

Each of the pair of side supports and the rear support may include a straight line shaped low portion supported by a bottom surface of the shell member in the second state.

At least one of the pair of side supports and the rear support may include: a 'U' shaped first support member including the straight line shaped low portion; and a second support having one portion rotatably connected to the upper loop and the other portion connected to the first support member.

The second support member may be formed so that the other portion thereof is inscribed in the lower portion of the first support member.

The second support member may be formed in a 'U' shaped, such that both end portions thereof spaced apart from each other are rotatably connected to the upper loop.

The foldable utility box may further include a strap formed to be protruded from the lower portion of at least one of the pair of side supports and the rear support while enclosing the lower portion.

The foldable utility box may further include an arch part formed at at least one of the pair of side supports and the rear support.

The arch part may be formed at the lower portion of at least one of the pair of side supports and the rear support so as to be convex toward the upper loop.

The foldable utility box may further include a reinforcing bar having one end portion connected to a convex portion of the arch part and the other end portion rotatably connected to the upper loop.

The pair of side supports and the rear support may have a circular cross section.

The shell member may be made of at least one of cloth and a resin film.

According to another exemplary embodiment of the present invention, there is provided a foldable utility box including: an upper loop made of a metal material and having a rectangular shape; a pair of side supports each rotatably connected to two short sides of the upper loop facing each other to thereby be changed between a first state in which they are in parallel with the upper loop or a second state in which they are vertical to the upper loop, and including a 'U' shaped first support member and a second support member disposed in the first support member so as to be connected to the first support member; and a shell member including at least one door part so as to approach the pair of side supports, formed to enclose the upper loop and the pair of side supports to thereby be folded in the first state and have a rectangular parallelepiped shape in the second state.

The second support may have one portion rotatably connected to the upper loop and the other portion connected to the first support member.

The second support member may be formed so that the other portion thereof is inscribed in the lower portion of the first support member.

According to still another exemplary embodiment of the present invention, there is provided a foldable utility box including: an upper loop made of a metal material and having a rectangular shape; a pair of side supports each rotatably connected to two short sides of the upper loop facing each other to thereby be changed between a first state in which they are in parallel with the upper loop or a second state in which they are vertical to the upper loop and including an arch part formed at at least a portion thereof; and a shell member including at least one door part so as to approach the pair of side supports and formed to enclose the upper loop and the pair of side supports to thereby be folded in the first state and have a hexahedral shape in the second state.

The arch part may be formed so as to be convex toward the upper loop.

The foldable utility box may further include a reinforcing bar having one end portion connected to a convex portion of the arch part and the other end portion rotatably connected to the upper loop.

A front surface of the shell member may be provided with one of the at least one door part and both sides thereof may face the pair of side supports, respectively, in the second state, and the foldable utility box may further include a rear support disposed to be rotatably connected to one of long sides of the upper loop to face a rear surface that is in parallel with the front surface in the second state.

The shell member may be made of at least one of cloth and a resin film.

Advantageous Effects

With the foldable utility box according to the exemplary embodiments of the present invention as described above, the foldable utility box may be changed between a box state and a folded state, and may appropriately maintain its form when it is in the box form. Therefore, when the foldable utility box is used, the foldable utility box maintains its form, such that the possibility that the article in the foldable utility box will be affected by a change in a form of the foldable utility box may be reduced, and when the foldable utility box is not used, it is folded, such that it may occupy a volume as small as possible.

In addition, in the case in which the foldable utility box maintains the box form, even though other articles or another foldable utility box are put on the foldable utility box to apply a load to the foldable utility box, the foldable utility box may ensure the load.

Further, an operation for changing between the use state and the non-use state of the foldable utility box may be simply performed.

DESCRIPTION OF DRAWINGS

The above and other objects, features and advantages of the present invention will become apparent from the following description of preferred embodiments given in conjunction with the accompanying drawings, in which.

DETAILED DESCRIPTION OF THE INVENTION

Figure 1:
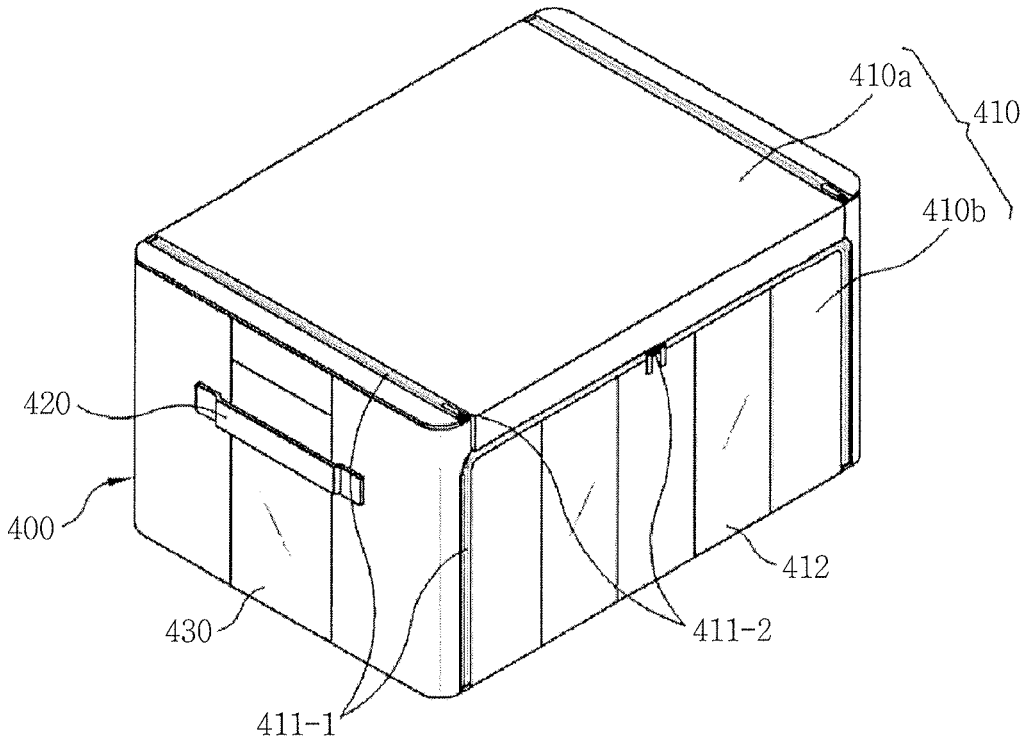
FIG. 1 is a perspective view of a foldable utility box according to an exemplary embodiment of the present invention.

First, a detailed configuration of a foldable utility box according to an exemplary embodiment of the present invention will be described with reference to FIGS. 1 to 5.

The foldable utility box according to the exemplary embodiment of the present invention may be mainly configured of two parts, that is, a part forming a skeleton of the foldable utility box and a part forming an appearance of the foldable utility box. More specifically, the part forming the skeleton may include an upper loop 100 and a pair of side supports 200, and the part forming the appearance may include a shell member 400. If necessary, the part forming the skeleton may further include a rear support 300 in addition to the upper loop 100, the pair of side supports 200.

The upper loop 100, the side support 200, and the rear support 300 are metal members having a circular cross section. When the upper loop 100, the side support 200, and the rear support 300 have the circular cross section, there is an advantage that a user may conveniently hold the upper loop 100, the side support 200, and the rear support 300 in order to operate them.

Figure 2:
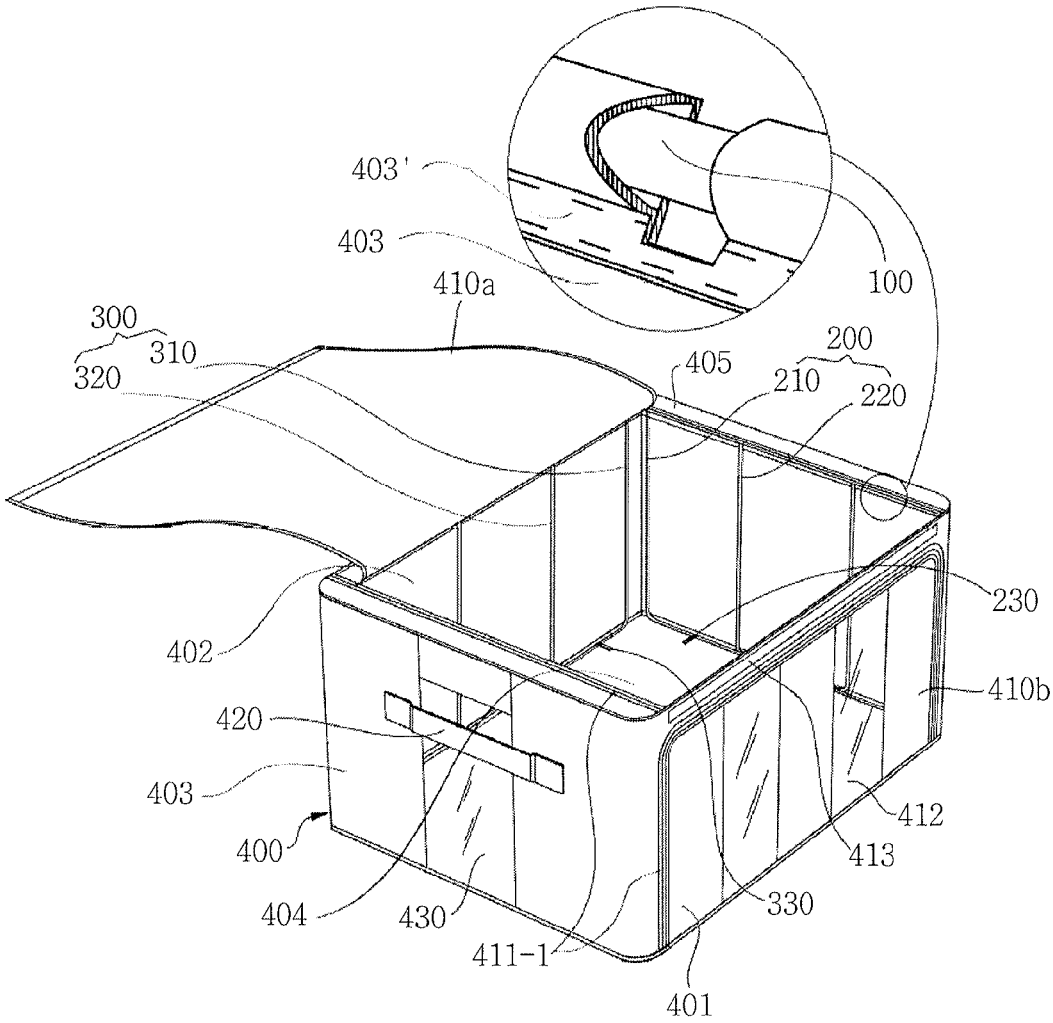
FIG. 2 is a perspective view showing the foldable utility box of FIG. 1 in a state in which a first door part 410*a* is opened.

The upper loop 100 is horizontally provided while having a rectangular shape to form a skeleton for four corners of an upper surface of a rectangular parallelepiped shape of the foldable utility box. The upper loop 100 may be fixed to an upper end of the shell member 400. More specifically, as shown in FIG. 2, an upper end 403' of a side 403 may be connected to a remaining portion of the side 403 by sewing, or the like, while enclosing the upper loop 100. Although the case in which the upper loop 100 has the rectangular shape and the foldable utility box has the rectangular parallelepiped shape is described by way of example in the present embodiment, the upper loop 100 may also have a square shape and the foldable utility box may also have a cube shape. Therefore, in consideration of all of the plurality of cases described above, it may also be defined that the upper loop 100 has a tetragonal shape and the foldable utility box has a hexahedral shape.

Figure 3:
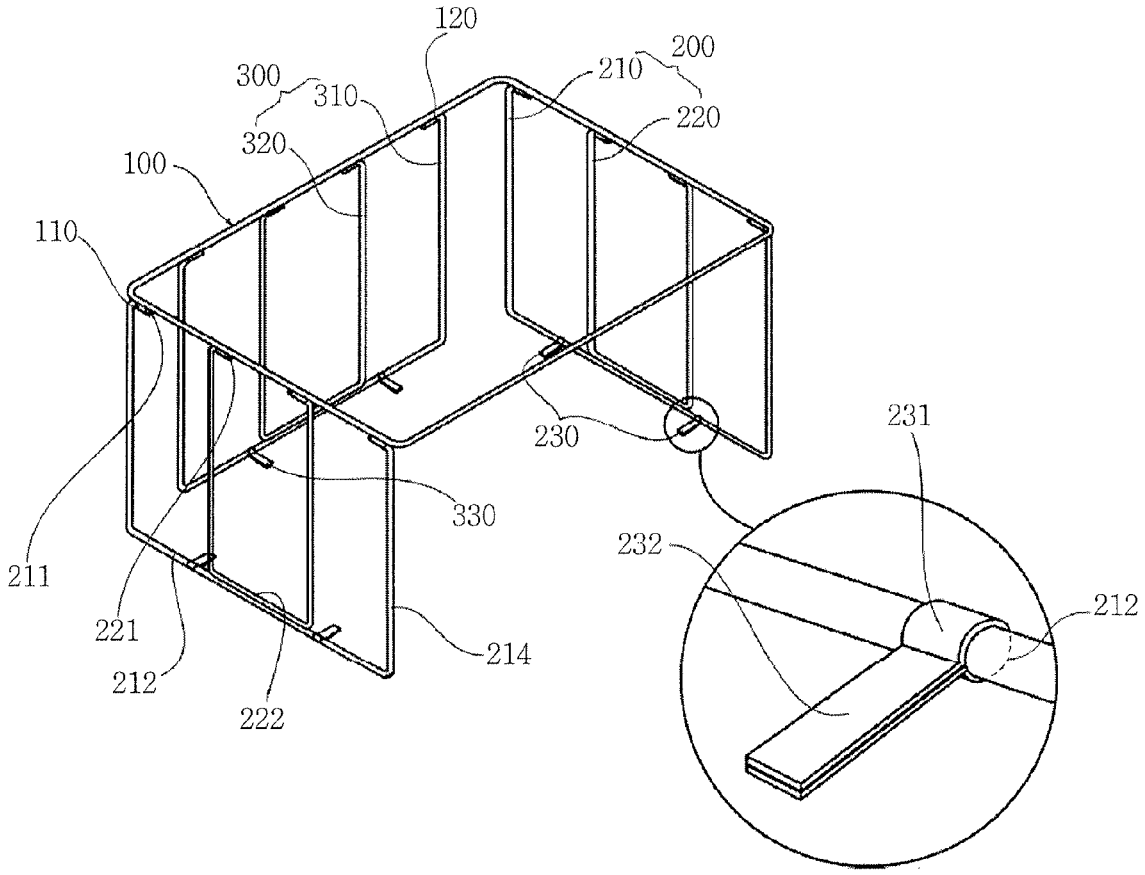
FIG. 3 is a perspective view showing the foldable utility box of FIG. 1 in a state in which a shell member 400 is removed.
Figure 4:
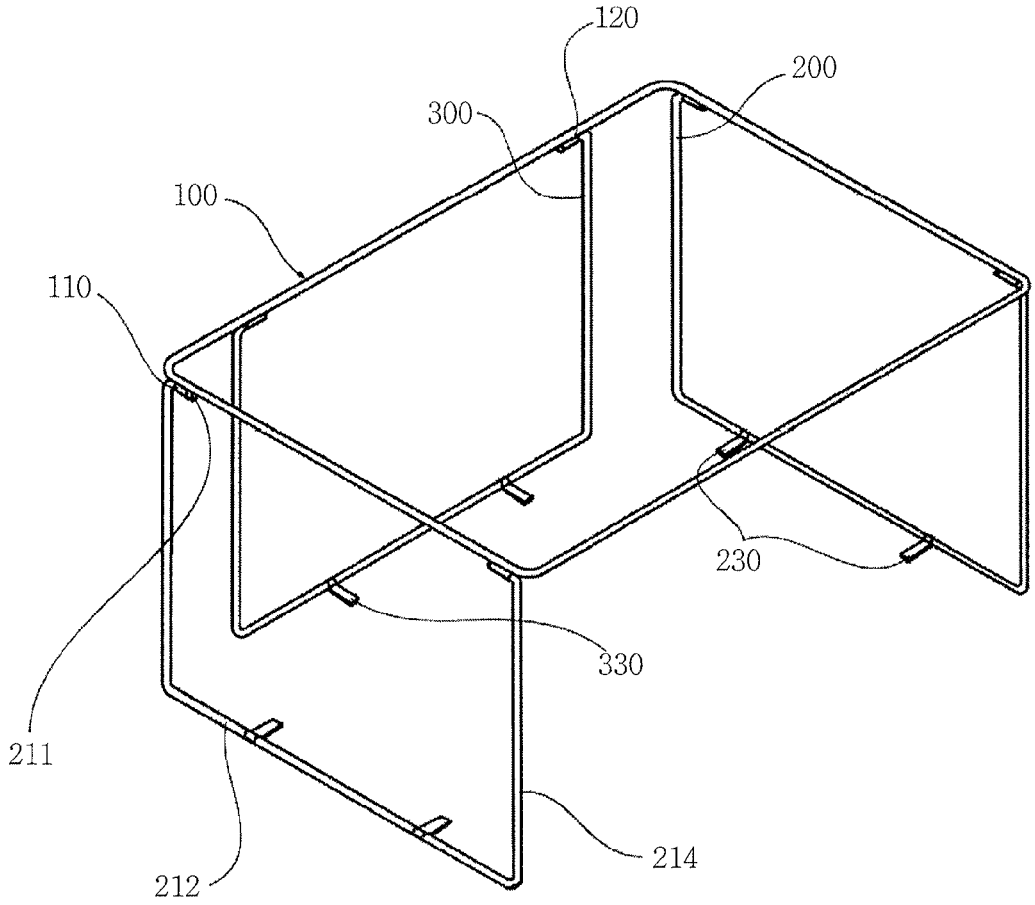
FIG. 4 is a perspective view showing an assembly of an upper loop 100, a side support 200, and a rear support 300 according to a modified example of FIG. 3.

The upper loop 100 is provided with a plurality of first hinge parts 110 rotatably connecting the pair of side supports 200 thereto and a plurality of second hinge parts 120 rotatably connecting the rear support 300 thereto, as shown in FIGS. 3 and 4. The first and second hinge parts 110 and 120 are provided with recesses into which the side support 200 and the rear support 300 are rotatably inserted, respectively. However, the first and second hinge parts 110 and 120 are not limited to having the above-mentioned configuration, but may have any configuration as long as they may rotatably connect the side support 200 and the rear support 200 to the upper loop 100.

The pair of side supports 200 are rotatably connected to both sides (short sides) of the upper loop 100 having the rectangular shape, respectively. The side support 200 is rotated from a state (first state) in which it is substantially in parallel with the upper loop 100 to another state (second state) in which it is substantially vertical to the upper loop 100 to support the upper loop 100. The pair of side supports 200 are disposed to face both sides of the foldable utility box (or the shell member 400), respectively, in the second state.

To this end, referring to FIG. 4, each of the pair of side supports 200 may be formed in a rectangular shape in which a central portion of one side thereof is opened, wherein one sides of the pair of side supports 200 may have lengths corresponding to those of both sides of the upper loop 100 facing each other. In other words, the side support 200 may be formed in a substantially "U" shape, such that both distal ends 211, 221 (see FIGS. 3 and 4) thereof may be rotatably inserted into the first hinge parts 110 of the upper loop 100, respectively. A lower portion 212 of the side support 200 is formed in a straight line shape and is supported by a bottom surface 404 of the shell member 400 in the second state.

The pair of side supports 200 may have a shape in which a first support member 210 and a second support 220 are combined with each other as shown in FIG. 3 (and FIG. 2) in order to improve structural strength. The first support member 210 has the 'U' shape as described above and has the lower portion 212 formed in the straight shape. The second support member 220 is connected to the first support member 210 so as to be positioned in the area defined by the first support member 210. More specifically, the second support member 220 is also formed in the 'U' shape, such that both ends 221 thereof may be rotatably connected to the first hinge parts 110 of the upper loop 100 and a straight line portion of a lower portion 222 thereof may be connected to a straight line portion of the lower portion 212 of the first support member 210 so as to be inscribed in the straight line portion of the lower portion 212 of the first support member 210. Therefore, the second support member 220 may be formed to have a width narrower than that of the first support member 210 and the substantially same height as that of the first support member 210. Unlike this, the second support member 220 may also be formed so as to be extended from any one of both side column parts 214 of the first support member 210 to the other thereof.

The lower portion 212 of the pair of side supports 200 may be further provided with a strap 230, as shown in FIGS. 2 to 4. The strap 230 is formed in a shape in which it is protruded from the lower portion 212 while enclosing the lower portion 212. The side support 200 may not be slid with respect to the bottom surface 404 of the shell member 400 in the second state by a portion 231 of the strap 230 enclosing the lower portion 212. In addition, a protruded portion 232 of the strap 230 corresponds to a portion that may be held and pulled by the user when the user is to change the side support 200 to be in the first state. As a result, the strap 230 helps maintain a form of the foldable utility box in the second state and makes an operation for changing the side support 600 to be in the first state convenient.

The pair of side supports 200 serve as two legs positioned at both sides of the foldable utility box to support the upper loop 100 and the shell member 400, and the rear support 300 serves to assist the side supports 200 at the rear of the foldable utility box to support the upper loop 100 and the shell member 400. Therefore, the rear support 300 is rotatably connected to a side close to a rear surface 402 between long sides of the upper loop 100.

The rear support 300 has a configuration similar to that of the side support 200 described above. In other words, first and second support members 310 and 320 are similar to the first and second support members 210 and 220, respectively. In addition, just as the side support 200 is rotatably connected to the upper loop 100 through the first hinge part 110, the rear support 300 is rotatably connected to the upper loop 100 through the second hinge part 120. Further, just as the side support 200 is provided with the strap 230, the rear support 300 may also be provided with a strap 330. Therefore, since a detailed configuration and action of the rear support 100 are similar to those of the side support 200, a description thereof will be omitted.

The shell member 400 is supported by the pair of side supports 200 and the upper loop 100 in the second state in which the pair of side supports 200 are rotated while forming a right angle with respect to the upper loop 100, respectively, and encloses the upper loop 100 and the pair of side supports 200 to form an appearance having a rectangular parallelepiped shape. The shell member 400 is made of a flexible material such as a foldable cloth material or a resin film material and includes at least one door part 410 that may be selectively opened to allow the user to insert or withdraw a storage article thereinto or therefrom. The user may put his/her hand in the foldable utility box through the door part 410 to operate the side support 200 and the rear support 300 in order to change between the first and second states.

The door part 410 may include a first door part 410*a* allowing an upper surface 405 of the shell member 400 having a rectangular parallelepiped shape to be opened and a second door part 410*b* allowing a front surface 401 of the shell member 400 to be opened.

Figure 5:
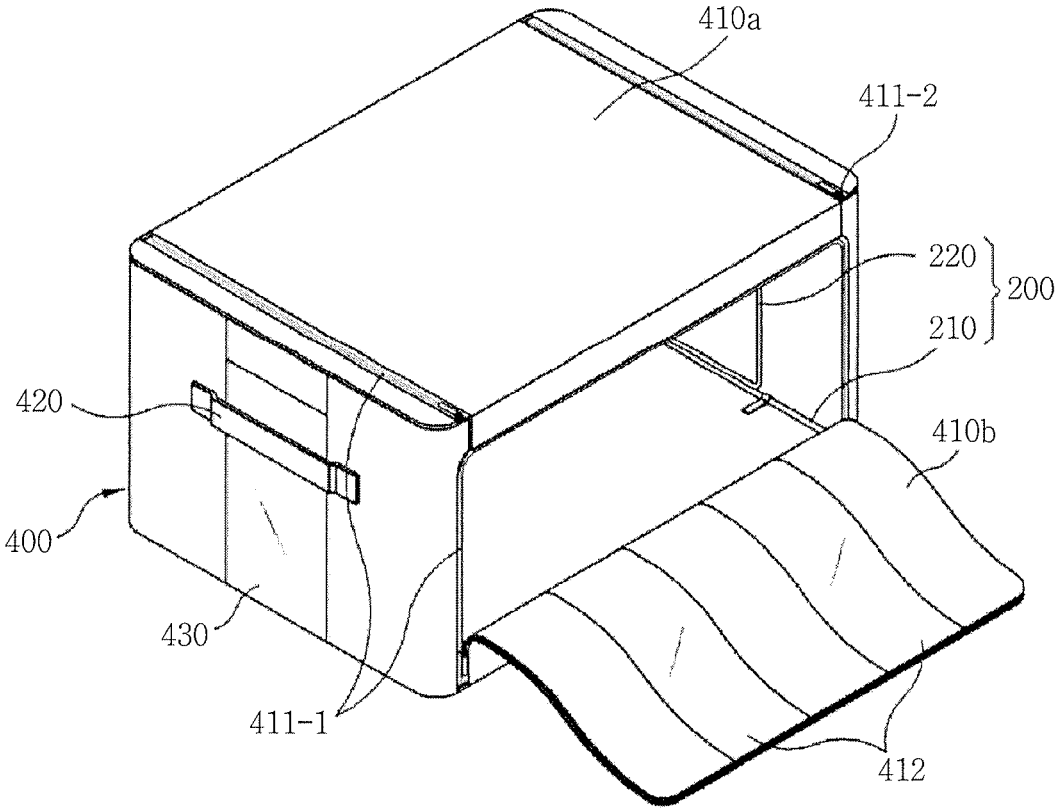
FIG. 5 is a perspective view showing the foldable utility box of FIG. 1 in a state in which a second door part 410*b* is opened.

Therefore, the foldable utility box may allow the user to insert or withdraw the storage article thereinto or therefrom through the upper surface of the shell member 400 as the first door part 410*a* is opened as shown in FIG. 2 or allow the user to insert or withdraw the storage article thereinto or therefrom through the front surface of the shell member 400 as the second door part 410*b* is opened as shown in FIG. 5.

Each of the first and second door parts 410*a* and 410*b* may be provided to be opened by a zipper, and zipper lines 411-1 of the first and second door parts 410*a* and 410*b* may be provided to be spaced apart from the corners of the rectangular parallelepiped shape of the shell member 400 by a predetermined distance so that the upper loop 100 and the pair of side supports 200 are not exposed to the outside as the first and second door part 410*a* and 410*b* are opened. A component capable of selectively opening the first and second door parts 410*a* and 410*b* is not limited to the zipper. That is, the first and second door parts 410*a* and 410*b* may be selectively opened in various schemes.

Further, in the exemplary embodiment of the present invention, as shown in FIG. 2, a distal end of a front side of the first door part 410*a* may be fixed or separated through an adhering part 413 such as a Velcro. Although the case in which the distal end of the front side is formed so as not to cover a zipper handle 411-2 of the second door part 410*b* has been described by way of example, the present invention is not limited thereto. That is, the distal end of the front side of the first door part 410*a* may also be more lengthily formed to thereby cover the zipper handle 411-2 of the second door part 410*b*.

Sides of the shell member 400 may be provided with handles 420 facilitating transportation of the foldable utility body, wherein positions, shapes, and the number of handles 420 are not limited according to the exemplary embodiment of the present invention.

The side of the shell member 400 may be provided with a transparent window 430 made of a material such as a transparent resin, or the like, so that the storage article of an inner portion of the foldable utility body may be confirmed at an outer portion of foldable utility body even in a state in which both of the first and second door parts 410*a* and 410*b* are closed. In addition, the second door part 410*a* may also be provided with a transparent window 412. In another exemplary embodiment of the present invention, the first door part 410*a* may also be provided with the above-mentioned transparent window.

Although not described in the exemplary embodiment of the present invention, a separate partition capable of partitioning the inner portion of the foldable utility box is provided and installed at an inner surface of the shell member 400, thereby making it possible to improve use efficiency of the inner portion of the foldable utility box.

Figure 6:
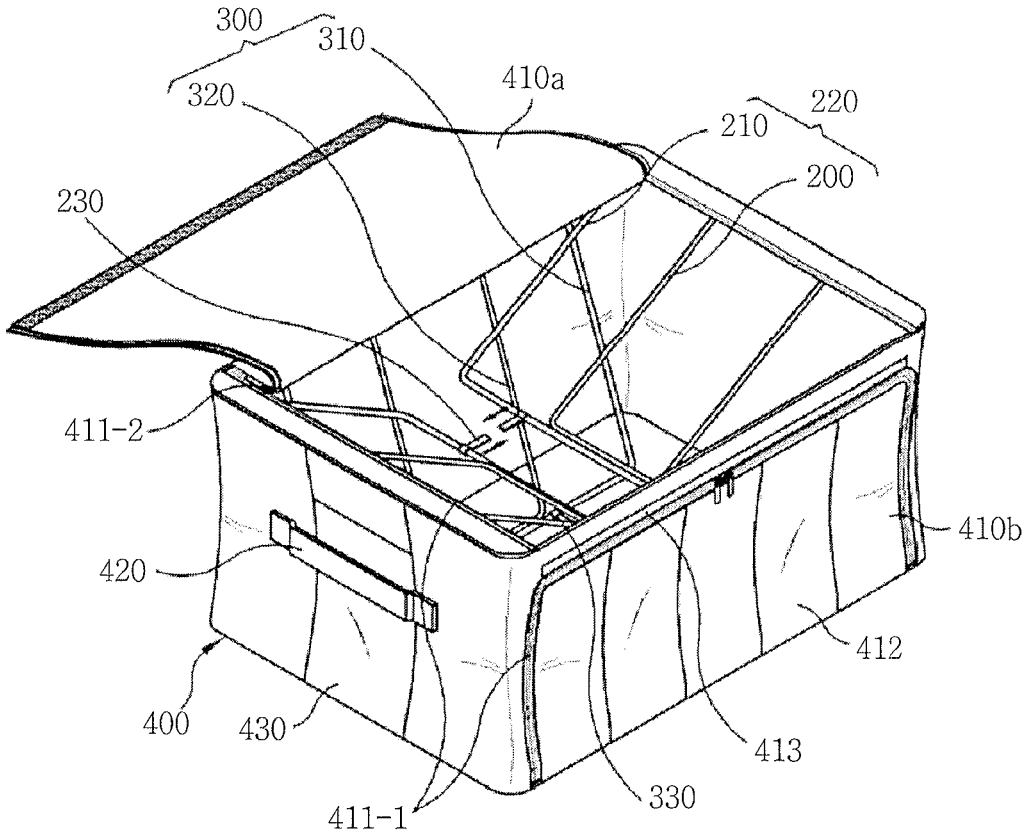
FIGS. 6 and 7 are perspective views for sequentially describing a process in which the foldable utility box of FIG. 1 is folded or unfolded.

Hereinafter, a changing process between a use state and a non-use state of the foldable utility box according to the exemplary embodiment of the present invention will be described in detail with reference to FIGS. 2, 6 and 7.

First, a process of changing the foldable utility box from a use state in which it stores an article to a state in which it does not store the article will be described.

As shown in FIG. 2, a plurality of straps 230 and 330 provided at the pair of side supports 200 and the rear support 300 are held and pulled in a state in which the first door part 410*a* is opened.

In this case, the pair of side supports 200 and the rear support 300 serving as the legs supporting the upper loop 100 and the shell member 400 release the support for the upper loop 100 while being rotated with respect to the upper loop 100. Therefore, the upper loop 100 descends as shown in FIG. 6. In this case, four sides 403 of the shell member 400 are folded.

Figure 7:
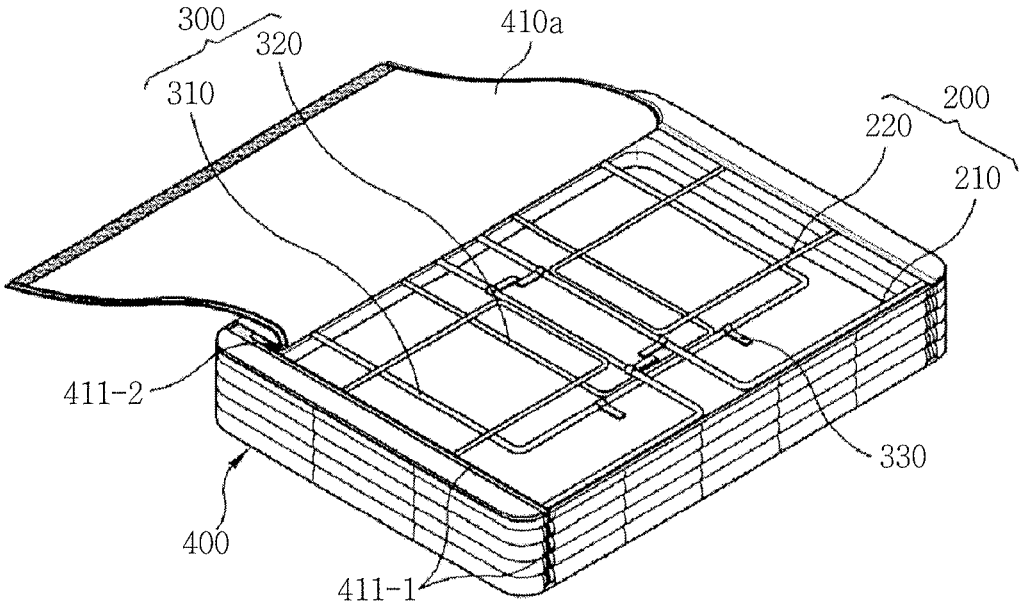

Then, when the pair of side supports 200 and the rear support 300 are rotated until they are horizontally overlapped with the upper loop 100 (they are in the first state), as shown in FIG. 7, the sides 403 of the shell member 400 are completely folded, such that the foldable utility box is deformed to be in a plate shape having a thin thickness. Then, when the first door part 410*a* is closed, storage and transportation of the foldable utility box become easy.

To the contrary, a process of changing the foldable utility box from the non-use state in which it is thinly folded at a small volume to the use state in which it may arrange the storage article therein is performed in a reverse sequence to the above-mentioned sequence, which will be described below in detail.

First, as shown in FIG. 7, the first door part 410*a* is opened. Then, as shown in FIG. 6, when the pair of side supports 200 and the rear support 300 are pushed toward the sides 403 through the first door part 410*a* to thereby be rotated with respect to the upper loop 100, the upper loop 100 ascends by the pair of side supports 200 and the rear support 300.

In this case, as the upper loop 100 ascends, the four sides 403 of the shell member 400 are naturally changed from a folded state to an unfolded state.

Then, as shown in FIG. 2, when the pair of side supports 200 stand up so as to form a skeleton for four vertical corners having a rectangular parallelepiped shape of the foldable utility box and the rear support 300 also stands up completely so as to be perpendicular to the upper loop 100, the four sides 403 of the shell member 400 are also unfolded completely, such that the foldable utility box having the rectangular shape is simply completed.

In the state in which the pair of side supports 200 and the rear support 300 completely stand up, the plurality of straps 230 and 300 provided at the pair of side supports 200 and the rear support 300 are strongly compressed to the bottom surface 404 of the shell member 400 to prevent sliding, thereby making it possible to further improve structural stability of the foldable utility box in the use state of the foldable utility box.

Next, a side support and the rear support according to other exemplary embodiment of the present invention will be described with reference to FIGS. 8 and 9. Hereinafter, although only side supports 500 and 600 according to other exemplary embodiments of the present invention will be described for convenience of explanation, a technical principle of the side supports may also be similarly applied to the rear support 300.

Figure 8:
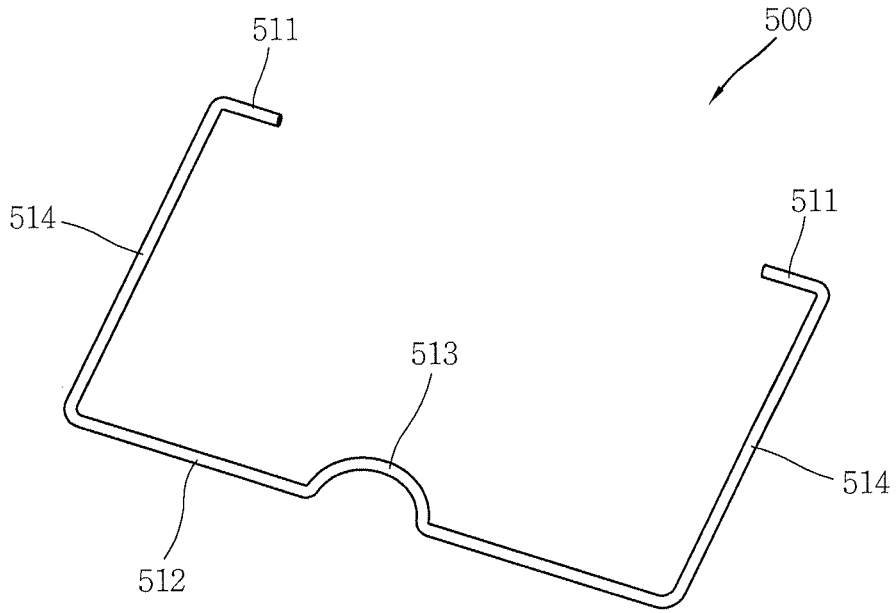
FIG. 8 is a perspective view showing a side support 500 according to another exemplary embodiment of the present invention.

FIG. 8 is a perspective view showing a side support 500 according to another exemplary embodiment of the present invention.

Referring to FIG. 8, the side support 500 is a metal member having a substantially 'U' shape. Both end portions 511 of an upper portion of the side support 500 are rotatably connected to the upper loop 100 (See FIG. 3) through the first hinge part 110 (See FIG. 3).

A lower portion of the side support 500 has a substantially a straight line shape 512, but may have an arch part 513 formed at the center thereof (See FIG. 8). The arch part 513 may be formed to be convex toward the upper loop 100 (See FIG. 3).

The arch part 513 is formed as described above, such that it may be lightly hit with a side of a fist when the side support 500 stands up in the second state in which it is vertical to the upper loop 100. Therefore, the possibility that it will be difficult to closely adhere the side support 500 to the side 403 due to interference with the bottom surface 404 (and the side 403) of the shell member 400 may be reduced.

In addition, the arch part 513 is formed, thereby making it possible to simply separate the side support 500 closely adhered to the side 403 of the shell member 400 from the side 404. The reason is that when the user hooks his/her finger around the arch part 513 to pull the side support 500, the side support 500 is separated from the side 404. Due to a function of the arch part 513 as described above, the strap 230 (See FIG. 3) in the above-mentioned embodiment of the present invention need not be separately provided.

Unlike this, the arch part 513 may be formed at any one of a pair of column parts 514 so as to be convex from any one of the pair of column parts 514 toward the other thereof.

Figure 9:
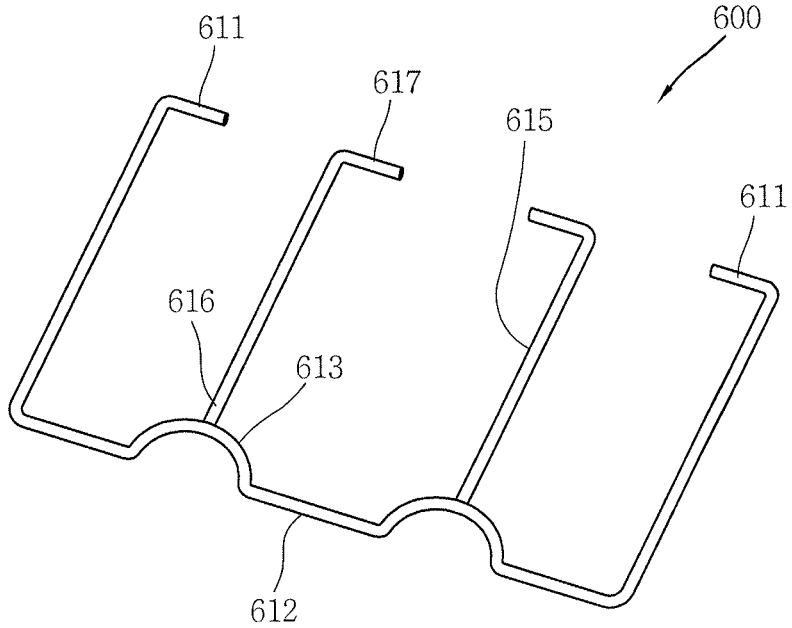
FIG. 9 is a perspective view showing a side support 600 according to still another exemplary embodiment of the present invention.

FIG. 9 is a perspective view showing a side support 600 according to still another exemplary embodiment of the present invention.

Referring to FIG. 9, the side support 600 also has a substantially 'U' shape and includes an arch part 613. The side support 600 includes two arch parts 613 formed at a lower portion 612 thereof. In addition, both end portions 611 of an upper portion of the side support 600 are also rotatably inserted into the first hinge parts 110 of the upper loop 100 (See FIG. 3), respectively.

Here, a reinforcing bar 615 may be connected to the arch part 613. The reinforcing bar 615 may have one end 616 connected to a convex portion of the arch part 613 and the other end 617 rotatably inserted into the first hinge part 119 of the upper loop 100.

According to the above-mentioned configuration, the arch part 613 may more robustly endure a compression load from the reinforcing bar 615 thereto as compared with the straight line lower portion 612. This is caused by a structural feature of an arch structure robust to the compression load. Therefore, in addition to a strength reinforcing effect by the reinforcing bar 615 itself, the reinforcing bar 615 is connected to the arch part 613, such that structural strength of the side support 600 is further improved.

Although two arch parts 613 and two reinforcing bars 615 have been described by way of example in the present embodiment, only one arch part 613 and reinforcing bar 615 or three or more arch parts 613 and reinforcing bars 615 may also be provided if necessary.

Hereinabove, although the present invention has been described in detail with reference to the exemplary embodiments, it will be obvious to those skilled in the art that various modifications and alterations may be made without departing from the scope and spirit of the present invention. It should be understood that these modifications and alterations fall within the scope defined by the following claims.

The invention claimed is:

1. A foldable utility box comprising:

an upper loop formed in a rectangular shape;

a pair of side supports each rotatably connected to two sides of the upper loop facing each other to thereby be in a first state, in which the pair of side supports are parallel with the upper loop, or a second state, in which the pair of side supports are vertical to the upper loop; and a shell member including at least one door part so as to approach the pair of side supports and formed to enclose the upper loop and the pair of side supports to thereby be folded in the first state and have a hexahedral shape in the second state, wherein, in the second state, a front surface of the shell member is provided with the at least one door part and both sides of the shell member face the pair of side supports, respectively, such that the shell member has a rectangular parallelepiped shape, the foldable utility box further comprises a rear support disposed to be rotatably connected to one side other than the two sides of the upper loop to face a rear surface of the shell member that is parallel with the front surface in the second state, and at least one of the pair of side supports and the rear support includinq:

a 'U' shaped first support member including the straight line shaped low portion: and a second support having one portion rotatably connected to the upper loop and an other portion connected to the first support member, and the second support member being formed in a 'U' shaped such that both end portions thereof, spaced apart from each other, are rotatably connected to the upper loop.

2. The foldable utility box of claim 1, wherein each of the pair of side supports and the rear support includes a straight line shaped low portion supported by a bottom surface of the shell member in the second state.

3. The foldable utility box of claim 1, wherein the second support member is formed so that the other portion thereof is inscribed in the lower portion of the first support member.

4. The foldable utility box of claim 2, further comprising a strap formed to protrude from the lower portion of at least one of the pair of side supports and the rear support while enclosing the lower portion.

5. The foldable utility box of claim 2, further comprising an arch part formed in at least one of the pair of side supports and the rear support.

6. The foldable utility box of claim 5, wherein the arch part is formed at the lower portion of at least one of the pair of side supports and the rear support, and the arch has a convex portion which extends toward the upper loop.

7. The foldable utility box of claim 6, further comprising a reinforcing bar having one end portion connected to the convex portion of the arch part and another end portion rotatably connected to the upper loop.

8. The foldable utility box of claim 1, wherein the pair of side supports and the rear support have a circular cross section.

9. The foldable utility box of claim 1, wherein the shell member is made of at least one of cloth and a resin film.

10. A foldable utility box comprising:

an upper loop made of a metal material and having a rectangular shape;

a pair of side supports each rotatably connected to two short sides of the upper loop facing each other to thereby be changed between a first state, in which the pair of side supports are parallel with the upper loop, or a second state, in which the pair of side supports are vertical to the upper loop, and including a 'U' shaped first support member and a second support member disposed in the first support member so as to be connected to the first support member; and a shell member including at least one door part so as to approach the pair of side supports, formed to enclose the upper loop and the pair of side supports to thereby be folded in the first state and have a rectangular parallelepiped shape in the second state, and made of a cloth material;

wherein the second support member has a first portion rotatably connected to the upper loop and a second portion connected to the first support member, and the second support member is formed in a 'U°' shaped such that both end portions of the 'U' shape are spaced apart from one another and are rotatably connected to the upper in a loop.

11. The foldable utility box of claim 10, wherein the second support member is formed so that the second portion thereof is inscribed in a lower portion of the first support member.

12. A foldable utility box comprising:

an upper loop made of a metal material and having a rectangular shape;

a pair of side supports each rotatably connected to two short sides of the upper loop facing each other to thereby be changed between a first state, in which the pair of side supports are parallel with the upper loop, or a second state, in which the pair of side supports are vertical to the upper loop and including an arch part formed in at a portion thereof; and a shell member including at least one door part so as to approach the pair of side supports and formed to enclose the upper loop and the pair of side supports to thereby be folded in the first state and have a hexahedral shape in the second state, and the foldable utility box further comprising a reinforcing bar having one end portion connected to a convex portion of the arch part and another end portion rotatably connected to the upper loop.

13. The foldable utility box of claim 12, wherein the arch part is formed so as to have a convex portion which extends toward the upper loop.

14. The foldable utility box of claim 12, wherein a front surface of the shell member is provided with the at least one door part and both sides thereof face the pair of side supports, respectively, in the second state, wherein the foldable utility box further comprises a rear support disposed to be rotatably connected to one of long sides of the upper loop to face a rear surface that is parallel with the front surface in the second state.

15. The foldable utility box of claim 12, wherein the shell member is made of at least one of cloth and a resin film.

* * * * *